US007140984B2

(12) United States Patent
Mauser et al.

(10) Patent No.: US 7,140,984 B2
(45) **Date of Patent: *Nov. 28, 2006**

(54) RACKET FOR BALL GAMES AND PRODUCTION PROCESS

(75) Inventors: Johannes Mauser, Bregenz (AT); Klaus Rambach, Peiting (DE); Manfred Emberger, Lochau (AT); Johan Kotze, Bregenz (AT); Herfried Lammer, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 102 days.

This patent is subject to a terminal disclaimer.

(21) Appl. No.: 10/812,060

(22) Filed: Mar. 30, 2004

(65) Prior Publication Data

US 2005/0164812 A1 Jul. 28, 2005

(30) Foreign Application Priority Data

Jan. 23, 2004 (DE) ..... 10 2004 003 526

(51) Int. Cl.
*A63B 49/02* (2006.01)

(52) U.S. Cl. ..... 473/524; 473/537

(58) Field of Classification Search ..... 473/524, 473/535–537, 547

See application file for complete search history.

(56) References Cited

U.S. PATENT DOCUMENTS

| | | | | |
|---|---|---|---|---|
| 1,451,836 | A * | 4/1923 | Larned | 473/545 |
| 4,353,551 | A | 10/1982 | Arieh et al. | |
| 5,014,987 | A * | 5/1991 | Soong | 473/537 |
| 5,100,136 | A | 3/1992 | Chen | |
| 5,152,526 | A * | 10/1992 | Soong | 473/537 |
| 5,573,242 | A * | 11/1996 | Yoo | 473/521 |
| 6,447,412 | B1 * | 9/2002 | Filippini | 473/524 |
| 6,761,651 | B1 * | 7/2004 | Pai | 473/545 |
| 2002/0058557 | A1 | 5/2002 | Kanemitsu | |
| 2005/0164812 | A1 * | 7/2005 | Mauser et al. | 473/524 |
| 2005/0164813 | A1 * | 7/2005 | Mauser et al. | 473/524 |

FOREIGN PATENT DOCUMENTS

| | | |
|---|---|---|
| DE | 37 16708 A1 | 12/1988 |
| EP | 0 676 222 B1 | 6/2000 |
| GB | 2 334 894 A | 9/1999 |

* cited by examiner

*Primary Examiner*—Raleigh W. Chiu
(74) *Attorney, Agent, or Firm*—Finnegan, Henderson, Farabow, Garrett & Dunner LLP

(57) ABSTRACT

The present invention relates to an improved racket for ball games, in particular a tennis racket, squash racket, badminton racket, racquet ball racket or paddle tennis racket comprising a frame consisting of a racket head and a handle portion connected thereto and being formed of a frame profile, wherein the racket head defines a stringing plane. The frame profile comprises four trough-shaped depressions which are arranged opposite to one another in pairs and essentially symmetrical with respect to the longitudinal axis of the racket. The depressions are preferably formed in the area between two o'clock and four o'clock and/or eight o'clock and ten o'clock on the racket head. Particularly preferably, the positions are at about three o'clock and/or nine o'clock. The racket of the present invention thus exhibits particularly advantageous ball control characteristics.

21 Claims, 2 Drawing Sheets

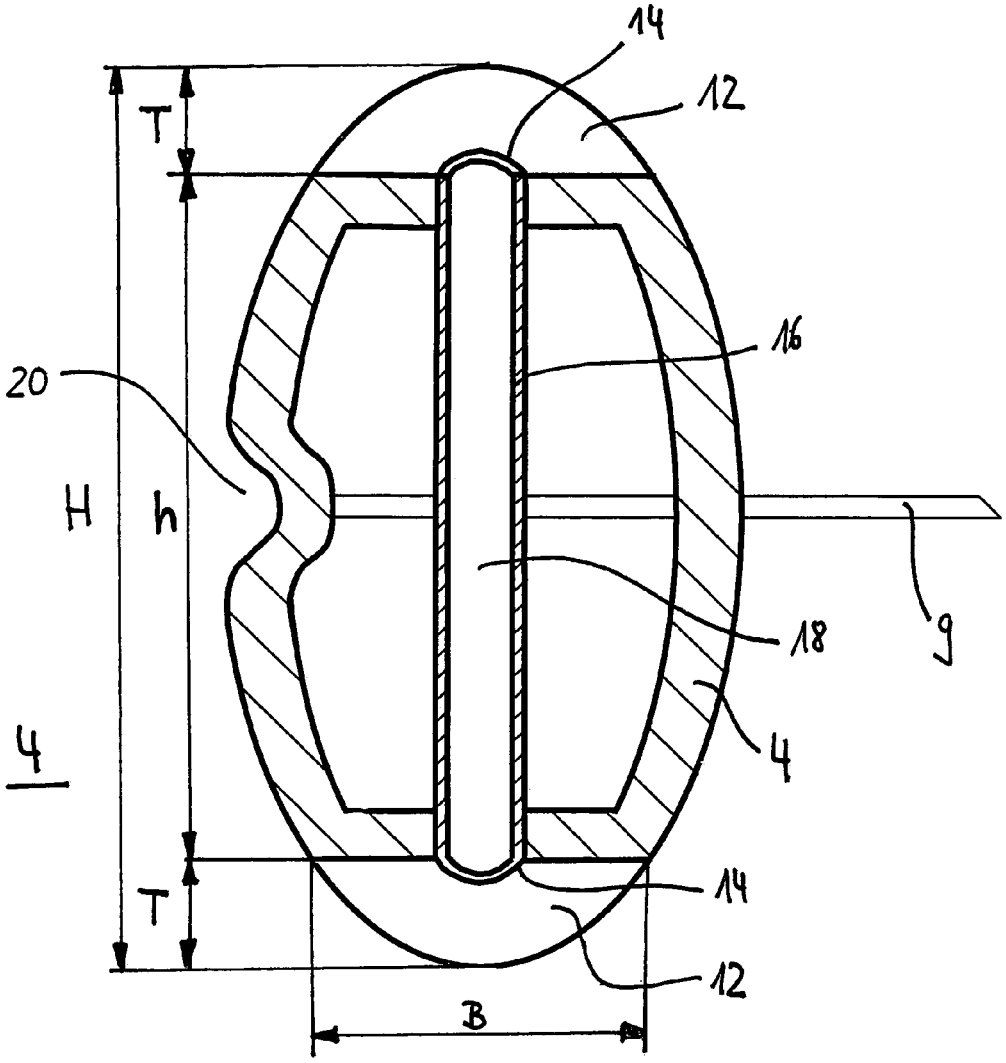
Fig. 4
Fig. 5
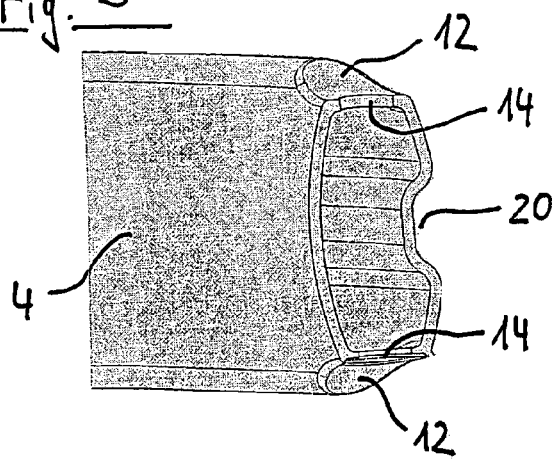

RACKET FOR BALL GAMES AND PRODUCTION PROCESS

The present invention relates to a racket for ball games, in particular a tennis racket, squash racket, badminton racket, racquet ball racket or paddle tennis racket having excellent handling properties, as well as a process for producing such a racket.

Rackets of this kind typically have a frame forming a racket head and a grip or handle portion connected thereto. A so-called heart region is typically formed in the transition area between the racket head and the handle portion. The frame is usually formed of a frame profile which is often produced of a carbon fiber reinforced plastics material in a molding press. The racket head of the racket defines a stringing plane in which the stringing of the racket is arranged. For receiving the individual strings of the stringing, through holes through which the individual strings can be passed are provided on the frame in the stringing plane.

Moreover, it is known to provide different cross-sectional shapes of the frame profile at different portions of the frame in order to be able to produce, e.g., relatively light-weight rackets. Also from other points of view it might be advantageous to provide frame profiles in which the cross-sectional shape changes along the frame.

For example, EP 0 676 222 B1 discloses a racket comprising a handle and a frame having a head portion, power reinforcing portions and flexible portions formed along the entire frame or along a part of the frame remote from the handle in an alternating manner. Each of the power reinforcing portions is constituted by a protruded frame portion having a relatively large side thickness as measured in a direction perpendicular to the plane of the frame. Each of the flexible portions is constituted by a depressed frame portion having a relatively small side thickness as measured in a direction perpendicular to the plane of the frame. The number of the protruded power reinforcing portions is 10 to 20 and the number of the depressed flexible portions is also 10 to 20. This racket construction is said to be capable of eliminating the insufficient acceleration ability of the conventional classic type racket construction as well as the insufficient flexibility of a conventional wide body racket.

It is the object of the present invention provide an improved racket allowing an excellent ball control and acceleration, wherein at the same time a light-weight construction is possible. This object is achieved with a racket comprising the features of independent claim 1. The dependent claims describe preferred embodiments of the racket of the present invention. Independent process claim 13 relates to a process for producing a racket of this kind. The claims depending thereon relate to advantageous embodiments of the process of the present invention.

The ball game racket of the present invention comprises a frame which is formed of a frame profile or hollow profile and has a racket head and a handle portion being connected thereto preferably via a heart region. The racket head defines a stringing plane. The frame profile comprises four trough-shaped depressions which are arranged in pairs opposite to one another and symmetrical with respect to the longitudinal axis of the racket.

The trough-shaped depressions are preferably arranged at the frame profile in such a way that in a direction perpendicular with respect to the stringing plane of the racket there is a reduced cross-section or necking.

The shape of the racket head is to a great extend arbitrary and can be oval, egg-shaped, drop-shaped, or rectangular with rounded edges. For defining the position of the trough-shaped depressions along the circumference of the racket head, usually the dial of a clock is used, wherein the twelve o'clock position is located at the outermost or free end of the racket head (cf. FIG. 1). The three o'clock position and nine o'clock position are accordingly located approximately in the middle of the overall length of the racket head.

The four trough-shaped depressions are preferably arranged on the racket head in such a manner that a first pair is provided between two o'clock and four o'clock, in particular at about three o'clock, and a second pair is provided between eight o'clock and ten o'clock, in particular at about nine o'clock. The trough-shaped depressions are thus approximately at the same distance from the handle end of the racket as the center of the impact or striking surface or the area of the impact or striking surface providing the maximum impact speed. If desired, this preferred position for the trough-shaped depressions can also be displaced about 1 cm to 4 cm, preferably also 2 cm to 3 cm, from the center in the direction towards the free end of the racket head.

Per racket side (front side or rear side), the racket of the present invention comprises two trough-shaped depressions, one of these depressions being arranged on the one side of the longitudinal axis of the racket and the other one being arranged on the other side. In other words, the racket of the present invention comprises only one single trough-shaped depression per racket side and half—i.e. a total of exactly four depressions. These depressions are preferably arranged in the area of about three o'clock and/or nine o'clock.

It is thus preferred to arrange one pair of trough-shaped depressions in the area between two o'clock and four o'clock, in particular at about three o'clock, and a further pair of trough-shaped depressions between eight o'clock and ten o'clock, in particular at about nine o'clock, i.e. the trough-shaped depressions are arranged opposite to one another in pairs and symmetrical with respect to the longitudinal axis of the racket.

The reduction in the cross-section, which is caused by the trough-shaped depressions arranged opposite to one another at the frame profile, is preferably dimensioned such that the frame height (in the direction perpendicular with respect to the stringing plane) is about 60 to 95%, preferably 70 to 90% and more preferably about 80% of the height of the frame profile outside the depressions. The length of the depressions along the frame preferably ranges between 10 mm and 30 mm, more preferably between 12 mm and 25 mm, most preferably between 15 mm and 23 mm. When viewing them in the direction of the stringing plane, the trough-shaped depressions preferably have an essentially circular cross-section having, e.g., a radius of about 15 mm to 25 mm, preferably about 20 mm. However, the cross-section can also be elliptical, hyperbolic, polygonal or rectangular with rounded edges.

The racket of the present invention is particularly advantageous in view of its improved ball control. Moreover, vibrations caused when hitting the ball are much less strongly led to the handle than in known rackets. At the same time, however, the acceleration ability, which can be transferred by means of the racket of the present invention to the ball, is improved. The advantageous properties of the racket of the present invention are presumably due to the fact that the trough-shaped depressions locally reduce the bending resistance moment of the frame profile so that these depressions form a kind of "joint" (control point).

The effect of the present invention can even be increased in that at least one opening extending through the frame profile and essentially perpendicular with respect to the stringing plane is provided in the area of the trough-shaped depressions. This opening preferably extends through the trough-shaped depressions which are arranged opposite to one another in pairs. When two openings are arranged symmetrical with respect to one another, any trough-shaped depression thus comprises one hole, so that in this area the outermost wall of the frame profile, i.e. the part of the wall of the frame profile having the greatest distance from the stringing plane, is considerably weakened so that the bending resistance moment of the frame profile is further weakened.

So far, such a weakening of the frame profile has been considered to be non realizable because it has been assumed that the frame would necessarily fracture due to the stress caused when playing with the racket. However, it turned out that the depressions and optionally openings not only allow a very good ball control but at the same time guarantee the required stability of the racket.

The trough-shaped depressions are preferably made while the racket is molded in the molding press. The optional openings are preferably made in the frame after the racket was molded in the molding press. However, they can also be made during the molding process by, e.g., placing a core into the mold. If the opening is made after the molding process, this is preferably done by drilling, milling or sawing.

In case the opening is made by drilling, its cross-section is usually circular cylindrical, but it can also have any other shape. A circular opening has preferably a diameter ranging between 2 mm and 8 mm, more preferably between 3 mm and 6 mm. In the case of an opening made by milling or sawing, the two opposite holes in the frame profile are usually made independent of one another, wherein each hole is preferably essentially bow-shaped or trough-shaped when being viewed from a direction parallel to the stringing plane. However, the holes can also have any other shape. The length of each of the holes along the frame preferably ranges between 1 mm and 10 mm, more preferably between about 3 mm and 7 mm. The depth of each hole corresponds at least to the wall thickness of the frame profile.

The widths of the holes, i.e. their dimensions in the direction of the through holes for the strings or perpendicular with respect to the frame at the corresponding positions preferably ranges between 3 mm and 7 mm. The dimensions of the hole, in particular its width and depth, should be selected such that the hole does not reach a groove provided in the frame for receiving a head band.

Analogously to the trough-shaped depressions, the openings are preferably arranged in pairs and essentially symmetrical with respect to the longitudinal axis of the racket, i.e. two, four, six or more openings can be provided symmetrical with respect to the longitudinal axis of the racket. The at least one opening is preferably arranged in the area between two o'clock and four o'clock and/or between eight o'clock and ten o'clock on the racket head. Particularly preferably, the openings are arranged in pairs in this area. More preferably, at least one pair of openings is provided at about three o'clock and/or nine o'clock on the racket head. Moreover, it can be advantageous to provide a plurality of openings per side. For example, a plurality of openings can be arranged symmetrically around the three o'clock and/or nine o'clock positions, or starting from three o'clock and/or nine o'clock towards the handle portion, or starting from three o'clock and/or nine o'clock towards the free end of the racket head. Preferably, each pair of opposite trough-shaped depressions contains one opening extending centrally therethrough.

In order to prevent dirt and/or moisture from entering the frame profile, the opening is preferably provided with an insert so that the frame profile is closed towards the interior. The insert is preferably tubular and has a through hole, but it can also be a solid element. The insert is usually made of an elastic material (e.g. rubber) so that the advantageous effects caused by the provision of the opening are influenced as little as possible. It is also possible to cover the holes forming the opening with a separate cover made of an elastic material, which leads to the same effect.

Moreover, it can be preferred to reinforce the frame profile in the area around the at least one opening by providing reinforcing or strengthening layers. Particularly advantageous for this purpose are strengthening layers of woven materials made of carbon fiber, glass or aramid and/or a unidirectional prepreg, which are each arranged at an angle of ±45° with respect to the longitudinal direction of the frame profile (i.e. spirally in the wall of the frame profile).

In the following, the racket of the present invention will be described exemplarily on the basis of preferred embodiments and with reference to the drawings in which FIG. 1 is a schematic front view of a racket of the present invention in which a dial of a clock is drawn in order to indicate the relevant fame positions;

FIG. 2*a* is an enlarged perspective view of an area of the frame of a racket of the present invention having a trough-shaped depression;

FIG. 2*b* is an enlarged perspective view of an area of the frame of a racket of the present invention having a trough-shaped depression and the optional opening;

FIG. 4 is a schematic cross-sectional view of the frame profile of a racket of the present invention according to the embodiment shown in FIG. 2; and FIG. 5 is a perspective sectional view of the frame profile of a racket of the present invention having trough-shaped depressions and the optional opening.

Figure 1:
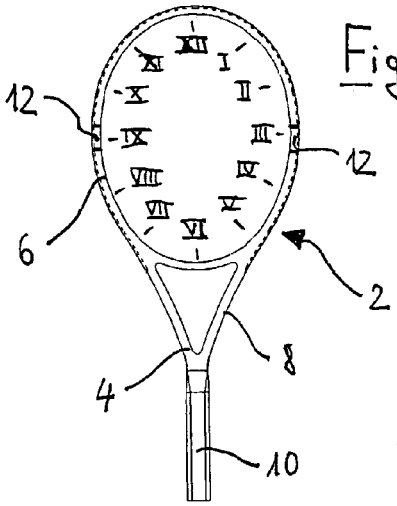

For a better understanding, the schematic representation of the racket 2 of the present invention shown in FIG. 1 contains a dial of a normal clock, wherein the twelve o'clock position (XII) is located at the outermost, free end of the racket.

Figure 3:
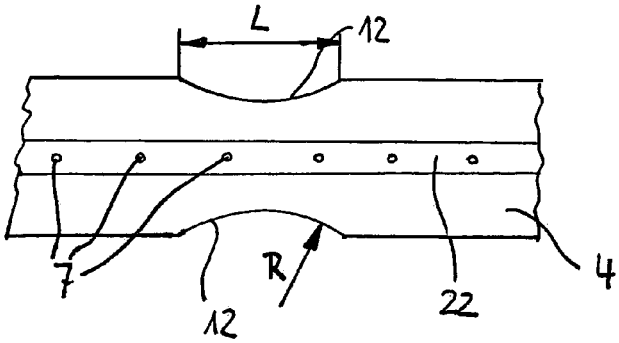
FIG. 3 is a schematic side view (view in the stringing plane) onto the frame of a racket of the present invention in the area of the trough-shaped depressions.

The racket 2 of the present invention comprises a frame 4 forming a racket head 6 and a handle portion 10 connected thereto preferably via a heart region 8. The frame 4 is made of a frame profile or hollow profile (cf. FIG. 4). The racket head defines a stringing plane of the racket. For receiving the stringing, the frame 4 comprises in the area of the racket head 6 a plurality of through holes 7 (FIG. 3) lying essentially in the stringing plane and serving for passing through them individual strings 9 of the stringing. In the cross-sectional view of FIG. 4, one of these strings is schematically shown.

In accordance with the invention, the frame profile generally comprises a pair of opposite trough-shaped depressions 12 between about two o'clock and four o'clock, in particular at three o'clock, and/or between about eight o'clock and ten o'clock, in particular at nine o'clock. Thus, a total of four depressions 12 are formed on the racket 2 of the present invention. Due to the depressions 12, in the direction perpendicular with respect to the stringing plane, the height of the frame is reduced in this area by two times the depth T of each of the trough-shaped depressions 12. The depths T of the opposite depressions 12 are preferably dimensioned such that in the area of the depressions there is a frame height h corresponding to about 60 to 95%, preferably about 70 to 90% and more preferably about 80% of the frame height H outside the depressions 12. For example, with a frame height H of 20 mm, the racket of the present invention has a frame height h of about 16 mm in the area opposite the depressions 12.

The length L of the trough-shaped depressions along the frame typically ranges between 10 mm and 30 mm, preferably between 12 mm and 25 mm and more preferably between 15 mm and 23 mm. Moreover, it is preferred that the trough-shaped depression 12 is essentially circular when being viewed in the direction of the stringing plane, wherein radiuses R ranging between 15 mm and 25 mm are preferred. A radius of about 20 mm is at present particularly preferable.

The width B of the trough-shaped depression, i.e. its dimension in the direction of the through holes for the strings and/or perpendicular with respect to the direction of the frame at the corresponding position, essentially depends on the cross-sectional shape of the frame profile and the depth T of the depression 12. However, the trough-shaped depressions typically extend essentially along the entire width of the frame profile.

For a racket having a frame height H of 19 mm and a radius of the trough-shaped depressions of 20 mm, the trough length L is about 17 mm and the trough depth T about 1.9 mm so that the frame height h in the area of the opposite depressions 12 is about 15.2 mm, i.e. about 80% of the frame height H. For a racket having a frame height H of 28.5 mm and the above-mentioned radius of the trough-shaped depressions, the trough length L is about 20.6 mm and the trough depth T about 2.85 mm. The remaining frame height h in the area of the depressions 12 is thus about 22.8 mm, which also corresponds to a reduction in the frame height to 80% of the frame height H outside the depressions 12.

Figure 2A:
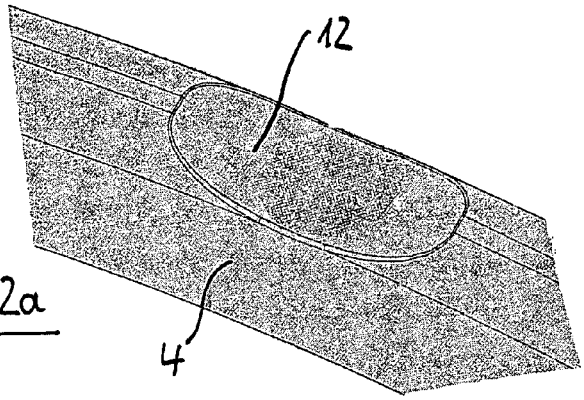

FIG. 2*a* shows a depression 12 in the frame 4 of the racket of the present invention in more detail.

Figure 2B:
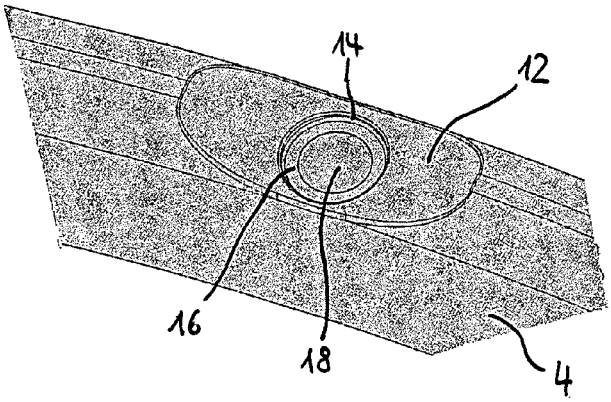

The embodiments of the racket 2 of the present invention as shown in FIGS. 2*b*, 4 and 5 furthermore comprise an optional opening 14 in the trough 12, said opening 14 extending essentially perpendicular with respect to the stringing plane and/or the through holes 7 for the strings 9 and through the frame profile up to the opposite trough 12, namely preferably through the center of the troughs. As shown in FIG. 2*b*, the opening 14 is formed as an essentially circular cylindrical through hole. The hole extends through the two opposite walls of the frame profile so that two opposite openings being in alignment with each other are formed in the frame profile. The diameter D of the opening preferably ranges between about 2 mm and 8 mm, more preferably between 3 mm and 6 mm.

In order to prevent dirt and/or moisture from entering the interior of the frame profile, the opening 14 is preferably provided with an insert 16 which closes the frame profile towards the interior of the opening 14. The insert 16 is preferably tubular, i.e. has a through hole 18. However, it can also be configured as a "cover" or as a solid profile. The insert 16 is typically made of a soft, elastic material, so that it does not considerably influence the properties of the racket in this area. Preferably a transparent plastics material (e.g. rubber) is used for this purpose. The tubular insert 16 has preferably a thin wall having a thickness of, e.g., about 0.5 to 1.5 mm, preferably about 0.5 to 1 mm.

A further way of providing the opening 14 in the frame 4 of the racket 2 of the present invention is to provide, instead of a through hole through the frame profile, both the front and back sides of the frame with individual holes. As already mentioned above, the two opposite holes together form an opening 14 extending through the frame profile. The holes can have any shape. However, when being viewed in the direction parallel to the stringing plane, they are essentially bow-shaped or trough-shaped. This can be realized, e.g., by milling or sawing.

The length of the holes along the frame preferably ranges between 1 mm and 10 mm, more preferably between 3 mm and 7 mm. The greatest depth of a hole corresponds to at least the wall thickness of the frame profile, so that the frame profile is at least in parts removed completely in order to expose an opening into the interior of the frame profile. The practicable maximum depth of the hole is preferably the depth up to a groove 20 (FIG. 4) for receiving a head band 22 (FIG. 3) of the racket. The width of the hole preferably ranges between 3 mm and 7 mm.

Also in case such holes are present, it is preferable to provide the opening with an essentially tubular insert or cover whose shape can be adapted to the shape of the hole so that neither dirt nor moisture can enter the interior of the frame profile.

The trough-shaped depressions 12 are preferably molded into the frame profile during the step of molding the racket frame 4 in a molding press, for example by providing a corresponding protrusion in the mold. Moreover, it might be preferable to provide in the area of the depressions 12 one or more strengthening layer(s) in the material forming the frame profile. For this purpose, for example a carbon fiber material, a woven material made of glass or aramid and/or a unidirectional prepreg can be incorporated into the frame profile forming the racket frame at an angle of ±45° with respect to the longitudinal direction of the frame profile (i.e. spirally in the wall of the frame profile). This is preferably done by stacking the different layers of frame material and strengthening material and subsequently rolling the stacked materials to form a "tube" which is then placed in the molding press and pressed under the influence of temperature and pressure to form the frame.

The racket of the present invention is advantageous in particular with respect to its improved ball control and the ability to accelerate the ball in an excellent manner. The advantageous properties of the racket of the present invention are presumably due to the fact that because of the trough-shaped depressions 12 the bending resistance moment of the frame profile is considerably lower than in areas of the frame having no depressions. Thus, a kind of "joint" is provided which leads to the particularly advantageous ball control characteristics of the racket. A further advantage of the racket of the present invention is its improved dampening.

The invention claimed is:

1. A racket for ball games including a frame having a racket head and a handle portion connected thereto and being formed of a frame profile, wherein the racket head defines a stringing plane and the frame profile comprises four trough-shaped depressions in the area of the racket head, said trough-shaped depressions being arranged opposite to each other in pairs and essentially symmetrical with respect to the longitudinal axis of the racket, wherein each pair of opposite depressions has an opening extending essentially perpendicular with respect to the stringing plane of the racket through the frame profile.

2. The racket according to claim 1, wherein a first pair of trough-shaped depressions is provided between two o'clock and four o'clock and a second pair of trough-shaped depressions is provided between eight o'clock and ten o'clock, wherein two of the trough-shaped depressions are formed on a front side of the racket and two of the trough-shaped depressions are formed on an opposite rear side of the racket.

3. The racket according to claim 1, wherein a first pair of trough-shaped depressions is formed at about three o'clock and a second pair of trough-shaped depressions is formed at about nine o'clock, wherein two of the trough-shaped depressions are formed on a front side of the racket and two of the trough-shaped depressions are formed on an opposite rear side of the racket.

4. The racket according to claim 1, wherein a first pair of trough-shaped depressions is displaced from the three o'clock position by about 2 to 3 cm towards a free end of the racket and a second pair of trough-shaped depressions is displaced from the nine o'clock position by about 2 or 3 cm towards the free end of the racket, wherein two of the trough-shaped depressions are formed on a front side of the racket and two of the trough-shaped depressions are formed on an opposite rear side of the racket.

5. The racket according to claim 1, wherein the opposite trough-shaped depressions each have a depth (T), so that when being viewed in a direction parallel to the stringing plane, there is a reduce frame height (h) ranging approximately between 60% and 95% of a frame height (H) next to the depressions.

6. The racket according to claim 5, wherein the reduced frame height (h) ranging approximately between 70% and 90% of a frame height (H) next to the depressions.

7. The racket according to claim 5, wherein the reduced frame height (h) is approximately 80% of a frame height (H) next to the depressions.

8. The racket according to claim 1, wherein a length (L) of each trough-shaped depression along the frame profile ranges between 10 mm and 30 mm.

9. The racket according to claim 1, wherein, when being viewed in the direction parallel to the stringing plane, each of the trough-shaped depressions is essentially circular and has a circular arc radius within the range between 15 mm and 25 mm.

10. The racket according to claim 9, wherein the circular arc radius is about 20 mm.

11. The racket according to claim 1, wherein the opening is circular cylindrical and has a diameter (D) ranging between 2 mm and 8 mm.

12. The racket according to claim 11, wherein the diameter (D) ranges between 3 mm and 6 mm.

13. The racket according to claim 1, wherein an essentially tubular insert is provided in the opening in order to close the frame profile towards the interior.

14. The racket according to claim 1, wherein in the area of the four trough-shaped depressions the frame profile comprises one or more strengthening layers.

15. The racket according to claim 14, wherein the strengthening layer comprises a woven fabric made of carbon fiber, glass or aramid and/or a unidirectional prepreg and is arranged at an angle of ±45° with respect to the longitudinal direction of the frame.

16. The racket according to claim 1, wherein the length (L) of each trough-shaped depression along the frame profile ranges between 12 mm and 25 mm.

17. The racket according to claim 1, wherein the length (L) of each trough-shaped depression along the frame profile ranges between 15 mm and 23 mm.

18. A process for producing a racket, comprising the following steps:

(a) forming a frame consisting of a frame profile and comprising a racket head and a handle portion connected thereto; and (b) providing four trough-shaped depressions which are arranged on the racket head opposite to one another in pairs and essentially symmetrical with respect to the longitudinal axis of the racket;

wherein the frame profile comprises at least one opening per depression.

19. The process according to claim 18, wherein the trough-shaped depressions are formed simultaneously with the frame during the step of molding the frame profile in a molding press.

20. The process according to claim 18, wherein the opening is formed by drilling, milling or sawing.

21. The process according to claim 18, wherein an essentially tubular insert is introduced into the opening in order to close the frame profile towards the interior.

* * * * *